US006339943B2

(12) United States Patent
Bertini et al.

(10) Patent No.: US 6,339,943 B2
(45) Date of Patent: Jan. 22, 2002

(54) DEVICE AND METHOD FOR ADJUSTING HOSIERY TENSION IN CIRCULAR TEXTILE MACHINES

(75) Inventors: Giovanni Bertini, Firenze; Paolo Brandani, Scandicci; Daniele Vivoli, Firenze, all of (IT)

(73) Assignee: Matec S.p.A., Scandicci (IT)

( * ) Notice: Subject to any disclaimer, the term of this patent is extended or adjusted under 35 U.S.C. 154(b) by 0 days.

(21) Appl. No.: 09/766,827

(22) Filed: Jan. 22, 2001

(30) Foreign Application Priority Data

Feb. 1, 2000 (IT) ..... MI00A0149

(51) Int. Cl.[7] ..... D04B 15/88
(52) U.S. Cl. ..... 66/149 R
(58) Field of Search ..... 66/147, 148, 149 R, 66/150, 152, 153

(56) References Cited

U.S. PATENT DOCUMENTS 2,574,009 A * 11/1951 Belford et al. ..... 66/149
3,214,944 A * 11/1965 Kienel ..... 66/149
3,306,080 A * 2/1967 Rossler ..... 66/149
3,797,280 A * 3/1974 Lonati ..... 66/149 R
4,236,390 A * 12/1980 Blank et al. ..... 66/149 R
4,945,734 A * 8/1990 Maruyama ..... 66/149 R
5,560,225 A * 10/1996 Salucci ..... 66/149 S
5,996,377 A * 12/1999 Cavalli ..... 66/149

* cited by examiner

*Primary Examiner*—Danny Worrell
(74) *Attorney, Agent, or Firm*—Guido Modiano; Albert Josif; Daniel O'Byrne

(57) ABSTRACT

A device for the electronic adjustment of hosiery tension in circular textile machines, whose particularity consists of the fact that it comprises an actuator which is adapted to move a carriage, which is in turn adapted to perform a translatory motion along an axis which is parallel to a diametrical axis of the circular textile machine, the carriage supporting at least one transducer connected to a hosiery advancement device, the transducer being adapted to detect a contrasting force which is due to the advancement of the hosiery item, the contrasting force being processed in a controller which is adapted to emit a speed signal for the actuator, in order to adjust the movement speed of the carriage in contrast with the contrasting force.

14 Claims, 3 Drawing Sheets

DEVICE AND METHOD FOR ADJUSTING HOSIERY TENSION IN CIRCULAR TEXTILE MACHINES

BACKGROUND OF THE INVENTION

The present invention relates to a device and a method for adjusting hosiery tension in circular textile machines.

It is known that one of the most important controls that can be performed during the knitting of a hosiery item is control of the force with which the hosiery item is drawn into the circular textile machine, in order to determine the quality of its fabric.

Conventional hosiery tensioning methods are of the pneumatic or mechanical type and are characterized by rigid and inaccurate adjustments. Moreover, the tension applied to the fabric being knit which is designed to constitute the hosiery item cannot be adjusted dynamically throughout the knitting; it is instead necessary to perform mechanical adjustments of the tensioning device, This clearly does not facilitate chances in the force applied to the fabric that the operator might want to perform.

Moreover, changes in the tension performed manually by the operator by acting on pneumatic or mechanical devices cannot be easily repeated and therefore the changes made in one operating step, seldom, are unlikely to be reproduced with accuracy and repeatability in the knitting of a different batch of hosiery items.

Moreover, pneumatic and mechanical adjustment devices do not allow to apply low-modulus forces and therefore tension adjustment tension is not very precise.

SUMMARY OF THE INVENTION

The aim of the present invention is to provide a device and a method for adjusting hosiery tension in circular textile machines, which allow dynamic adjustment throughout knitting.

Within the scope of this aim, an object of the present invention is to provide a device and a method for adjusting hosiery tension, which allow to easily modify the force applied to the fabric of the hosiery item during its production without any kind of constraint.

Another object of the present invention is to provide a device and a method for adjusting hosiery tension, which allow to include tension among the data that describe, from the textile point of view, the hosiery item to be manufactured.

Another object of the present invention is to provide a device and a method for adjusting hosiery tension in circular textile machines, which are highly reliable, relatively simple to manufacture and at competitive costs.

This aim and these and other objects which will become better apparent hereinafter are achieved by a device for the electronic adjustment of hosiery tension in circular textile machines, characterized in that it comprises actuation means which are adapted to move a carriage, which is in turn adapted to perform a translatory motion along an axis being parallel to a diametrical axis of said circular textile machine, said carriage supporting, at least one transducer connected to a hosiery advancement device, said transducer being adapted to detect a contrasting force due to the advancement of said hosiery item, said contrasting force being processed in controller means which are suitable to emit a speed signal for said actuation means, in order to adjust the movement speed of said carriage in contrast with said contrasting force.

BRIEF DESCRIPTION OF THE DRAWINGS

Further characteristics and advantages of the invention will become better apparent from the description of a preferred embodiment of the device and method according to the invention, illustrated only by way of non-limitative example in the accompanying drawings, wherein.

DESCRIPTION OF THE PREFERRED EMBODIMENTS

Figure 3:
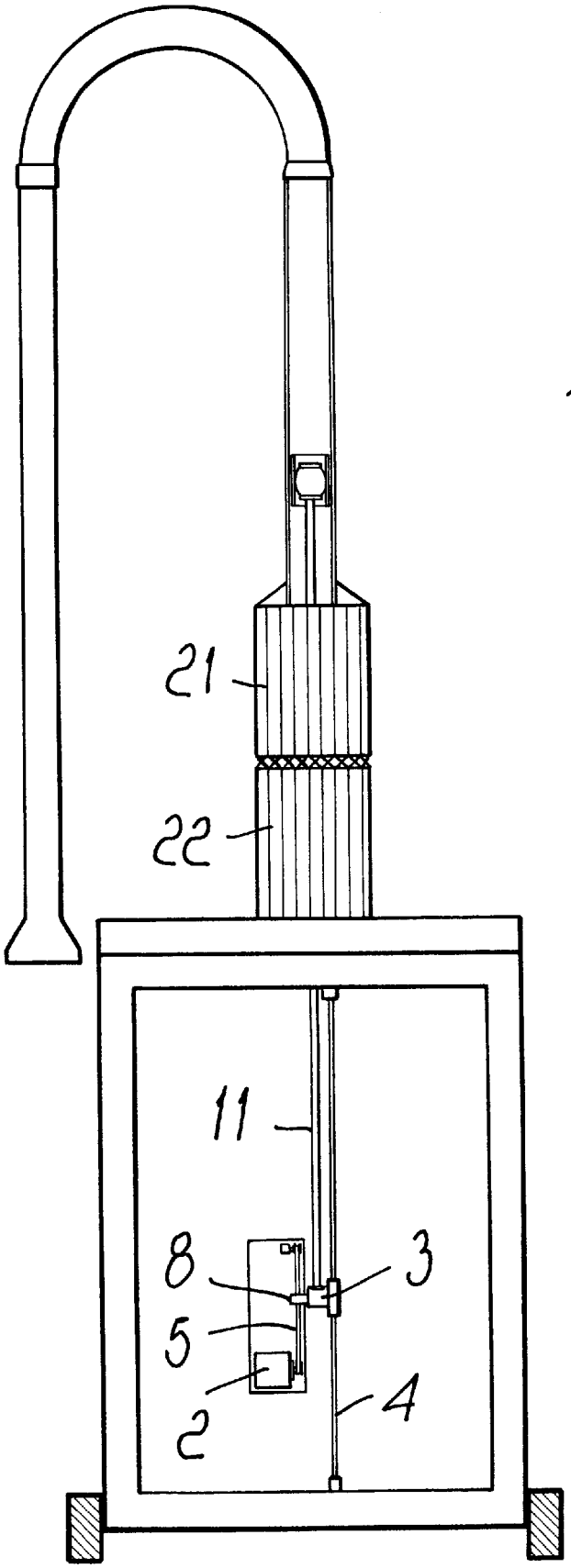
FIG. 3 is a schematic view of the tension adjustment device implemented in a circular textile machine.

With reference to the figures, the control device according to the present invention, generally designated by the reference numeral 1 and designed to be arranged below the needle cylinder or cylinders, comprises actuation means 2 which are adapted to actuate, with a translatory motion along the axis of the needle cylinders (for example, as shown in FIG. 3, respectively the upper cylinder 21 and the lower cylinder 22), a carriage 3 being kept guided on a guide 4 which is parallel to the axis of the needle cylinder or cylinders.

Conveniently, the actuation means 2 comprise a motor which moves the carriage 3 by way of a belt 5 and a pair of pulleys 6 and 7.

The carriage 3 is counted to the belt 5 by way of engagement means 8.

The carriage 3 is conveniently provided with at least one load cell 9, connected to supporting means 10 which are adapted to support a rod-like element 11 whereto the hosiery item being knit is attached The movement of the hosiery item during knitting occurs upward, i.e., in the opposite direction with respect to the arrow 127 which accordingly indicates the contrasting force that the hosiery item applies to the supporting element 10.

The hosiery item is engaged, by means of the thread, with the needles of needle cylinder or cylinders.

The contrasting force, indicated by the arrow 12, thus contrasts the advancement of the carriage 3, which moves in the opposite direction with respect to the arrow 12, as shown by the arrow 13.

Figure 1:
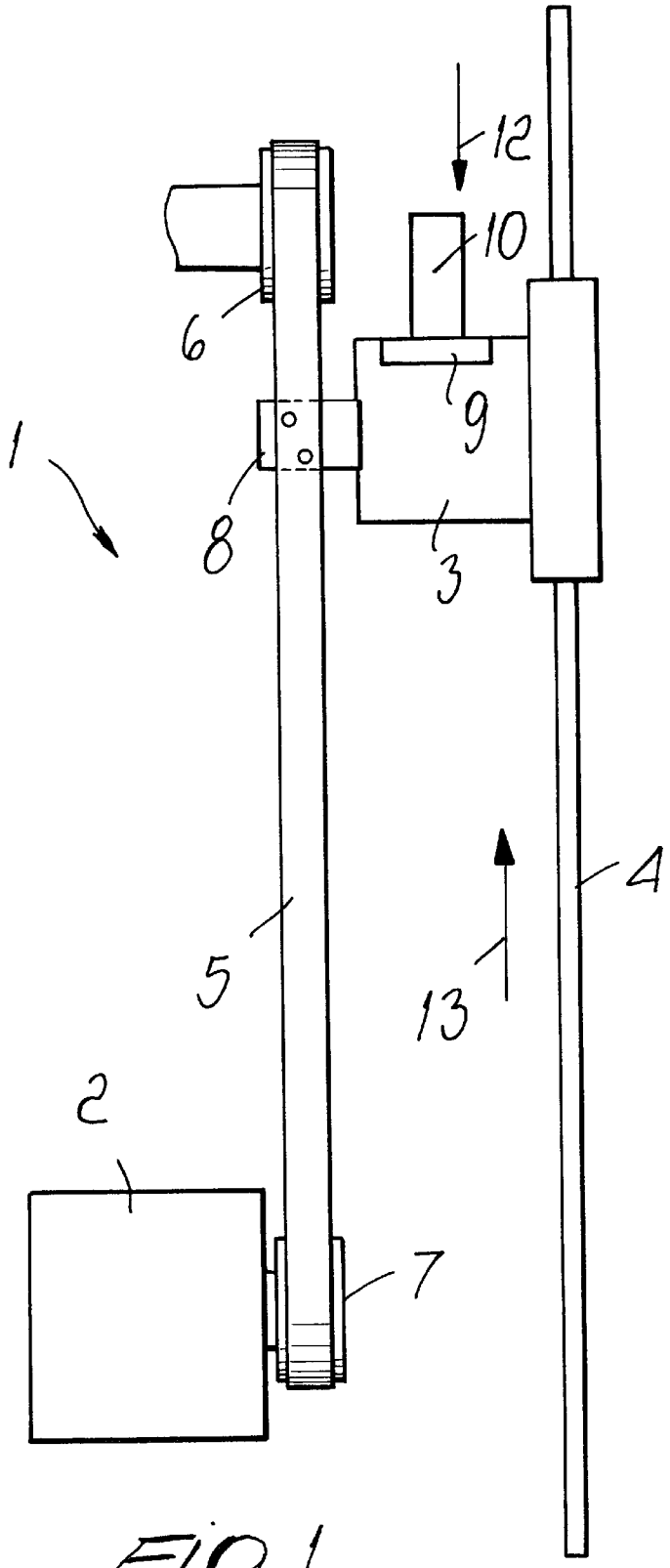
FIG. 1 is a schematic view of the tension adjustment device according to the present invention.
Figure 2:
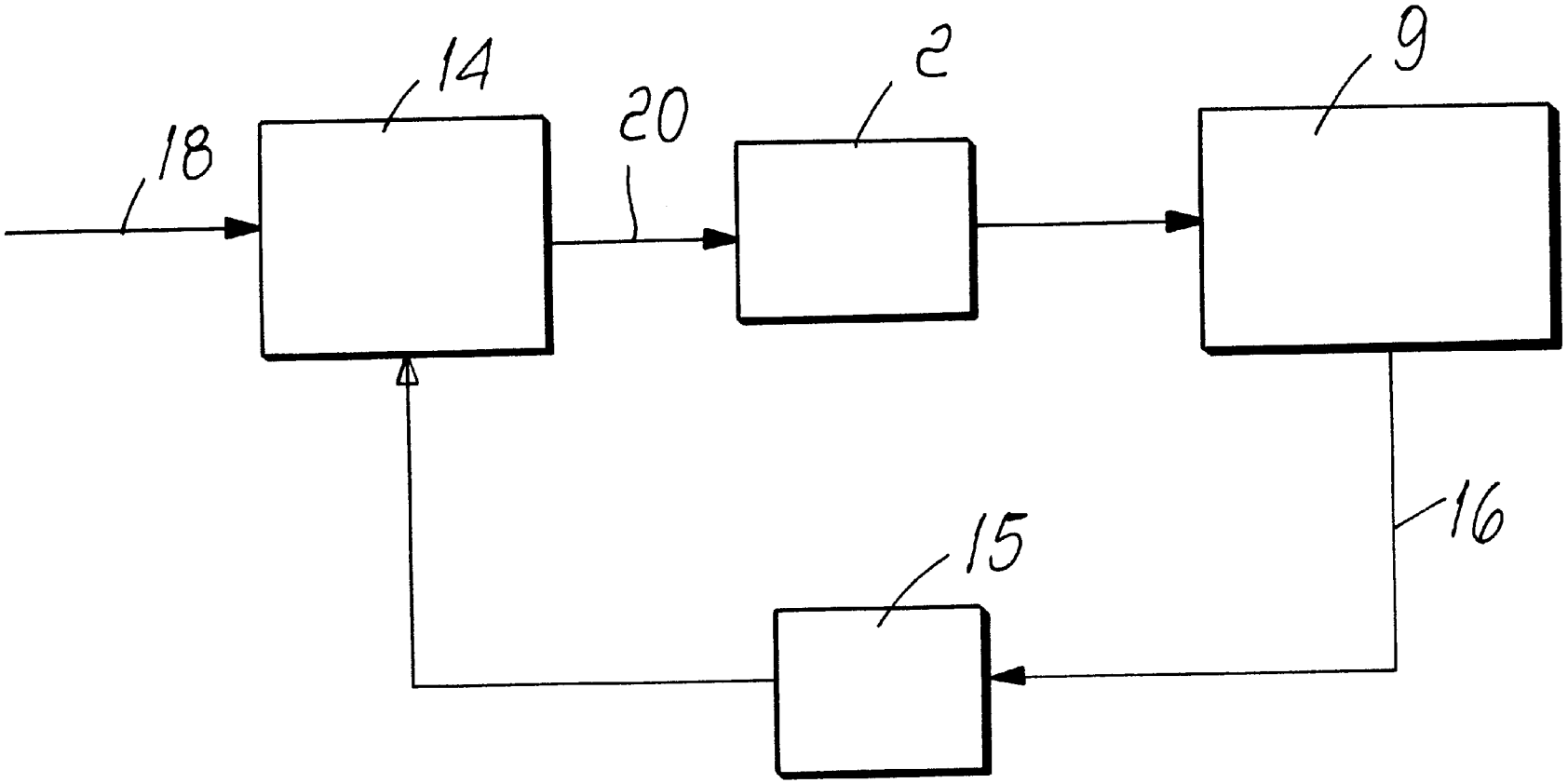
FIG. 2 is a block diagram of the control method according to the present invention.

FIG. 2 is a block diagram of the hosiery tension adjustment device, in which reference numeral 2 designates, as in FIG. 1, the electric motor, and reference numeral 9 designates a force transducer, for example the load cell 9 shown in FIG. 1.

The load cell 9 is arranged so as to be coupled to the movable carriage 3. The reference numeral 14 instead designates a generic control system which performs the following functions:

- analog-to-digital conversion of the signal that arrives from a signal amplifier 15 which is feedback-connected between the force sensor 9 and the control system 14;
- signal sampling;
- processing of the information by way of appropriate algorithms (comparison with a reference force signal 18);
- driving of the electric motor 2.

The force sensor or transducer 9 emits in output an electric signal 16 which is proportional to the force applied to the sensor 9. The amplifier 15 amplifies and cancels out any offset of the signal 16.

In practice, the operation of the device according to the invention is as follows.

A reference force 18, which must cause the advancement of the hosiery item during the various steps of its manufacture, is defined by way of an operator interface.

When hosiery tensioning is active, the load cell (force transducer) 9 measures a certain contrasting force 12. Said measurement varies substantially instantaneously as the stresses to which the fabric that constitutes the hosiery item vary.

The signal 16 of the load cell is conveniently amplified in the amplifier means 15 and is then sampled at the appropriate rates by the control system 14, which converts it into digital form and filters it.

The comparison between the signal thus amplified and filtered and the reference force signal 18 generates an error which is identified as the difference between the reference force signal 18 and the signal in output from the amplifier 15.

A speed reference signal 20 for the motor 2 that moves the carriage 3 along the guide 4, in the direction of the arrow 13, is generated according to a control algorithm, for example of the PID (proportional-integral-derivative) type.

By varying the speed of the cantage 3, the force applied to the hosiery item during its manufacture (knitting) is controlled.

The reference value for the force, constituted by the signal 18, thus becomes a parameter which depends both on the type of thread being processed and on the textile characteristics of the product.

In practice, therefore, it is possible to introduce tension among the data that describe, from the point of view of the textile characteristics, the hosiery item to be manufactured. The tension can be changed dynamically during such knitting, without any kind of constraint dictated by a device of the pneumatic or mechanical type.

This further allows greater precision and repeatability of the force is applied to the fabric.

Electronic adjustment of the tension of the hosiery item during its knitting thus provides for the presence of a control unit which is suitable to drive, with a given speed, the motor, which in turn drives the carriage to which the force transducer that measures the contrasting force applied by the hosiery item being knit is fixed.

The speed signal for the carriage actuation motor is obtained directly according to the reference force signal and to the signal emitted by the force transducer.

In practice it has been observed that the device and the method for adjusting hosiery tension according to the present invention, particularly for circular textile machines, fully achieve the intended aim and objects, since they allow to electronically control hosiery tension, with the possibility to dynamically vary the force applied to the fabric during knitting.

The device and the method thus conceived are susceptible of numerous modifications and variations, all of which are within the scope of the appended claims.

Thus, for example, the motor 2 can be a motor of the stepper type, with the corresponding power electronic systems, or it is possible to use, for example, a motor of the brushless type.

It is further possible to use a transducer other than the force sensor 9, such as for example a torque meter.

In practice, the materials employed, so long as they are compatible with the specific use, as well as the dimensions, may be any according to requirements and to the state of the art.

The disclosures in Italian Patent Application No. MI2000A000149 from which this application claims priority are incorporated herein by reference.

What is claimed is:

1. A device for an electronic adjustment of hosiery tension in circular textile machines, comprising: a carriage; actuation means for moving said carriage with a translatory motion along an axis which is parallel to a diametrical axis of said circular textile machine; at least one transducer supported at said carriage; a hosiery advancement device to which said transducer is connected, said transducer being adapted to detect a contrasting force due to an advancement of a hosiery item being knit; and controller means for processing information related to said contrasting force and emitting a speed signal for said actuation means, in order to adjust a movement speed of said carriage in contrast with said contrasting force.

2. The device of claim 1, further comprising: a guiding element; and movement means to which said carriage is connected, said movement means being actuated by said actuation means in an actuation direction so as to perform a translatory motion along said guiding element, which is arranged substantially parallel to the diametrical axis of said circular machine and to the actuation direction of said movement means.

3. The device of claim 1, wherein said transducer is a load cell.

4. The device of claim 2, wherein said movement means comprise a belt, said belt being actuated by said actuation means.

5. The device of claim 2, further comprising a signal amplifier means for amplifying a signal emitted by said transducer, said signal amplifier means being arranged in a feedback configuration between said transducer and said controller means.

6. The device of claim 5, wherein said controller means are adapted to receive an input reference force signal and to compare said reference force signal with a signal emitted in output by said amplifier means.

7. The device of claim 6, wherein said actuation means comprises an electric motor.

8. The device of claim 7, wherein said electric motor is a stepper motor.

9. The device of claim 7, wherein said electric motor is a brushless motor.

10. The device of claim 6, wherein said transducer is adapted to emit in output an electric signal which is proportional to a force applied thereto, said electric signal being sent to said signal amplifier means.

11. The device of claim 10, wherein said controller means comprises conversion means for analog/digital conversion of said signal emitted in output by said signal amplifier means, and sampling means for sampling said signal.

12. A method for adjusting a tension of a hosiery item in circular textile machines, comprising the steps of:

detecting a signal related to a contrasting force that a hosiery item being knit transmits to transducer means which is connected to a translatory element movable along a direction in which said contrasting force is applied;

sending the signal detected by said transducer means, which is proportional to said force applied to said transducer means, to controller means which receive an input reference force signal;

performing a comparison between said reference force signal and said signal sent by said transducer means;

on the basis of said comparison, generating a speed signal for actuation means for moving said translatory element in an opposite direction with respect to said direction in which said contrasting force is applied.

13. The method of claim 12, further comprising: a step of amplifying said signal sent by said transducer means before sending the signal to said controller means.

14. The method of claim 12, wherein said speed signal for said actuation means is generated dynamically during weaving of said hosiery item.

* * * * *